US009630186B2

(12) United States Patent
Back

(10) Patent No.: US 9,630,186 B2
(45) Date of Patent: Apr. 25, 2017

(54) METHOD AND A DEVICE FOR CLEANING AN ELECTROSTATIC PRECIPITATOR

(71) Applicant: ALSTOM Technology Ltd, Baden (CH)

(72) Inventor: Andreas Back, Växjö (SE)

(73) Assignee: General Electric Technology GmbH, Baden (CH)

( * ) Notice: Subject to any disclaimer, the term of this patent is extended or adjusted under 35 U.S.C. 154(b) by 266 days.

(21) Appl. No.: 14/280,756

(22) Filed: May 19, 2014

(65) Prior Publication Data

US 2014/0251371 A1 Sep. 11, 2014

Related U.S. Application Data

(63) Continuation of application No. PCT/IB2012/055953, filed on Oct. 28, 2012.

(30) Foreign Application Priority Data

Nov. 29, 2011 (EP) ..... 11191167

(51) Int. Cl.
*B03C 3/76* (2006.01)
*B03C 3/41* (2006.01)
(Continued)

(52) U.S. Cl.
CPC ..... *B03C 3/765* (2013.01); *B03C 3/41* (2013.01); *B03C 3/45* (2013.01); *B03C 3/66* (2013.01);
(Continued)

(58) Field of Classification Search
CPC combination set(s) only.
See application file for complete search history.

(56) References Cited

U.S. PATENT DOCUMENTS 2,976,951 A 3/1961 Lagarias
3,360,902 A * 1/1968 Glaeser ..... B03C 3/763 173/3
(Continued)

FOREIGN PATENT DOCUMENTS

CN 101622072 A 1/2010
CN 102069035 A 5/2011
(Continued)

OTHER PUBLICATIONS

Yang, "Study on Diagnostic Method and Inspecting Technology in Real Time for Failure in Electrostatic Precipitator", Doctoral Dissertation, Dalian University of Technology, pp. 1-10, 2004.
(Continued)

*Primary Examiner* — Duane Smith
*Assistant Examiner* — Sonji Turner
(74) *Attorney, Agent, or Firm* — GE Global Patent Operation; Rita D. Vacca

(57) ABSTRACT

A method of cleaning at least one collecting electrode of an electrostatic precipitator includes applying, in a first mode of operation, a first average current between at least one discharge electrode and at least one collecting electrode, and switching from the first mode of operation to a second mode of operation in which a second average current is applied between the at least one discharge electrode and the at least one collecting electrode, the second average current being a factor of at least 3 higher than the first average current, to achieve a forced cleaning of the at least one collecting electrode.

14 Claims, 4 Drawing Sheets

(51) Int. Cl.

| | |
|---|---|
| ***B03C 3/45*** | (2006.01) |
| ***B03C 3/66*** | (2006.01) |
| ***B03C 3/74*** | (2006.01) |

(52) U.S. Cl.
CPC ..... *B03C 3/74* (2013.01); *B03C 3/763* (2013.01); *B03C 2201/24* (2013.01)

(56) References Cited

U.S. PATENT DOCUMENTS

| | | | | |
|---|---|---|---|---|
| 4,070,163 | A | 1/1978 | Kolb et al. | |
| 4,526,591 | A | 7/1985 | Getzin | |
| 4,746,331 | A * | 5/1988 | Truce | B03C 3/68 95/2 |
| 5,282,891 | A | 2/1994 | Durham | |
| 5,311,420 | A | 5/1994 | Zarfoss et al. | |
| 5,477,464 | A * | 12/1995 | Jacobsson | B03C 3/68 323/903 |
| 6,178,765 | B1 | 1/2001 | Hironaka et al. | |
| 7,001,447 | B1 | 2/2006 | Altman et al. | |
| 8,328,902 | B2 * | 12/2012 | Boyden | B03C 3/763 95/26 |
| 2010/0037766 | A1 * | 2/2010 | Boyden | B03C 3/763 95/2 |
| 2010/0037767 | A1 * | 2/2010 | Boyden | B03C 3/763 95/5 |

FOREIGN PATENT DOCUMENTS

| | | | | |
|---|---|---|---|---|
| DE | 4132874 | * | 12/1992 | B03C 3/68 |
| DE | 197 51 984 | | 5/1999 | |
| DE | 19751984 | A1 * | 5/1999 | B03C 3/66 |
| EP | 1 967 275 | | 9/2008 | |
| EP | 1 967 276 | | 9/2008 | |
| EP | 2 078 563 | | 7/2009 | |
| JP | S59-042055 | | 3/1984 | |
| JP | H01-053106 | | 11/1989 | |
| JP | H04-075789 | | 12/1992 | |
| JP | 2514411 | | 7/1996 | |
| JP | H08-252480 | | 10/1996 | |
| JP | 2004-349145 | | 12/2004 | |
| JP | 2008-221175 | | 9/2008 | |
| WO | 83/00297 | | 2/1983 | |
| WO | 97/41958 | A1 | 11/1997 | |
| WO | 2007/051239 | | 5/2007 | |

OTHER PUBLICATIONS

Tian et al., "Modern Technology for Dust Removing of Fume", Chemical Industry Press, pp. 1-12, 2008.
Peng, "Study on Factors Influencing Dusting Efficiency of Electrostatic Precipitator", A Dissertation in Environmental Engineering, pp. 1-6, 2009.
Chinese Office Action issued in connection with corresponding CN Application No. 201280058724.0 on May 11, 2016.
"Dust Collector", Electric Dust Collector, pp. 1-42.

* cited by examiner

METHOD AND A DEVICE FOR CLEANING AN ELECTROSTATIC PRECIPITATOR

CROSS-REFERENCE TO RELATED APPLICATIONS

This application claims priority to PCT/IB2012/055953 filed Oct. 28, 2012, which claims priority to European application 11191167.3 filed Nov. 29, 2011, both of which are hereby incorporated in their entireties.

TECHNICAL FIELD

The present invention relates to a method of cleaning at least one collecting electrode of an electrostatic precipitator, which is operative for removing dust particles from a process gas and which comprises at least one discharge electrode and at least one collecting electrode.

The present invention further relates to a device which is operative for cleaning at least one collecting electrode of an electrostatic precipitator.

BACKGROUND

In the combustion of a fuel, such as coal, oil, peat, waste, etc., in a combustion plant, such as a power plant, a hot process gas is generated, such process gas containing, among other components, dust particles, sometimes referred to as fly ash. The dust particles are often removed from the process gas by means of an electrostatic precipitator, also called ESP, for instance of the type illustrated in EP 2 078 563.

One problem associated with ESPs is the so-called back-corona effect, i.e. that a high electrical resistivity of a layer of already collected dust particles on a collecting electrode causes dielectric break-down of the dust layer during operation which may reduce the ESP collection efficiency.

EP 2 078 563 discloses an electrostatic precipitator with improved capability of reducing the negative effects of back-corona. The ESP is controlled based on an indicator signal which is indicative of the temperature of combustion air which is fed to the combustion air process.

Operating an ESP in accordance with EP 2 078 563 may reduce the negative effect of back-corona to some extent. However, back-corona effects may still influence the operation of the ESP in a negative manner.

SUMMARY

An object of the present invention is to provide a method of cleaning at least one collecting electrode of an electrostatic precipitator, ESP, that alleviates the mentioned back-corona problem.

This object is achieved by a method of cleaning at least one collecting electrode of an electrostatic precipitator, which is operative for removing dust particles from a process gas and which comprises at least one discharge electrode and the at least one collecting electrode, said method being characterized in comprising: applying, in a first mode of operation, a first average current between the at least one discharge electrode and the at least one collecting electrode, and switching from the first mode of operation to a second mode of operation in which a second average current is applied between the at least one discharge electrode and the at least one collecting electrode, the second average current being a factor of at least 3 higher than the first average current, to achieve a forced cleaning of the collecting electrode.

The inventor has found that the forced strong back-corona that will result when increasing the current may be used to clean, or assist cleaning of, collecting electrodes of an electrostatic precipitator. The method is thus based on the realization that temporarily intensified back-corona effects may be used to clean collecting plates of an ESP from dust. Forced cleaning may thus be achieved via induced back-corona in the dust layer. Hence, a forced back-corona operation may be used intermittently in order to clean collecting electrodes from high resistivity dust so that back-corona problems will be minimized during normal operation. When there is a need for forced cleaning of collecting plates the operation is switched to a second mode of operation. During the second mode of operation back-corona effects are intensified by the increased current applied between the electrodes. An advantage of this method is that collecting plates of an ESP can be cleaned from high resistivity dust. Operational disturbances due to sticky high resistivity dust may thus be reduced. Furthermore, the cleaning is carried out in a cost-effective manner since the method may be integrated into an existing ESP controller and high voltage supply without the need of additional hardware and/or equipment.

According to one embodiment the mode of operation is switched from the first mode of operation to the second mode of operation in response to a forced cleaning signal which is indicative of a need for forced cleaning of the at least one collecting electrode.

Preferably, the second average current is a factor in the range of 5 to 200 higher than the first average current and more preferably the second average current is a factor in the range of 10 to 100 higher than the first average current.

According to one embodiment the electrostatic precipitator is operated in the second mode of operation during a predetermined time interval. Preferably, the electrostatic precipitator is operated in the second mode of operation during a predetermined time interval which is in the range of 20 seconds to 30 minutes, more preferably during a predetermined time interval which is in the range of 30 seconds to 15 minutes, and most preferably during a predetermined time interval which is in the range of 1 to 5 minutes.

According to one embodiment switching of the mode of operation is preceded by rapping the at least one collecting electrode. An advantage of this embodiment is that some dust can be removed by means of rapping before the second mode of operation is entered. The amount of dust that is ejected back in the gas flow during operation in the second mode of operation is thereby reduced.

According to one embodiment rapping of the at least one collecting electrode is carried out during the second mode of operation. An advantage of carrying out rapping while operating the electrostatic precipitator in the second mode of operation is that the cleaning of the collecting electrode may be further improved due to synergy of the cleaning effect of the rapping event with the cleaning effect of the forced back-corona operation.

According to one embodiment a forced cleaning signal is generated by means of a back-corona detection system. An advantage of this embodiment is that the operation of the ESP may be automatically switched to the second mode of operation as soon as there is a need for forced cleaning of the collecting electrode. A back-corona cleaning operation may thus be carried out as soon as there is a need to remove dust from a collecting plate in order to minimize operational disturbances.

According to one embodiment a forced cleaning signal is generated by means of a timer. An advantage of this embodiment is that a very simple and robust control of the cleaning of collecting plates may be provided.

According to one embodiment the method further comprises generating a, forced cleaning signal by means of a dust particle measurement device measuring the dust particle concentration downstream, as seen with respect to the flow direction of the process gas, of the at least one collecting electrode.

According to one embodiment the method further comprises utilizing a rapping schedule for the cleaning of the at least one collecting electrode and issuing a forced cleaning signal on regular intervals in the rapping schedule.

According to one embodiment a forced cleaning signal is based on an algorithm employing a combination of two or more of a back-corona detection system, a timer, a dust particle measurement device and a rapping schedule. This embodiment has the advantage that further tuning possibilities as regards the generation of a forced cleaning signal are achieved.

According to one embodiment the electrodes of the electrostatic precipitator are fed with current pulses, wherein the intermittent time between current pulses is shorter in the second mode of operation compared to the first mode of operation. The intermittent time may e.g. be decreased when switching from the first mode of operation to the second mode of operation by utilizing more available pulses in a semi-pulse arrangement.

A further object of the present invention is to provide a device which is operative for controlling the operation of an electrostatic precipitator and which has improved capability of reducing the mentioned back-corona problem while maintaining efficient removal of dust particles from a process gas.

This object is achieved by means of a device for controlling the cleaning of at least one collecting electrode of an electrostatic precipitator, which is operative for removing dust particles from a process gas and which comprises at least one discharge electrode and the at least one collecting electrode, said device being characterized by being operative for:

applying, in a first mode of operation, a first current between the at least one discharge electrode and the at least one collecting electrode, and switching from the first mode of operation to a second mode of operation in which a second current is applied between the at least one discharge electrode and the at least one collecting electrode, the second current being a factor of at least 3 higher than the first current.

An advantage of this device is that it is operative for controlling the cleaning of at least one collecting electrode such that operational disturbance due to back-corona problems in the first mode of operation may be reduced.

Further objects and features will be apparent from the description and the claims.

BRIEF DESCRIPTION OF THE DRAWINGS

The invention will now be described in more detail with reference to the appended drawings in which.

DETAILED DESCRIPTION

Figure 1:
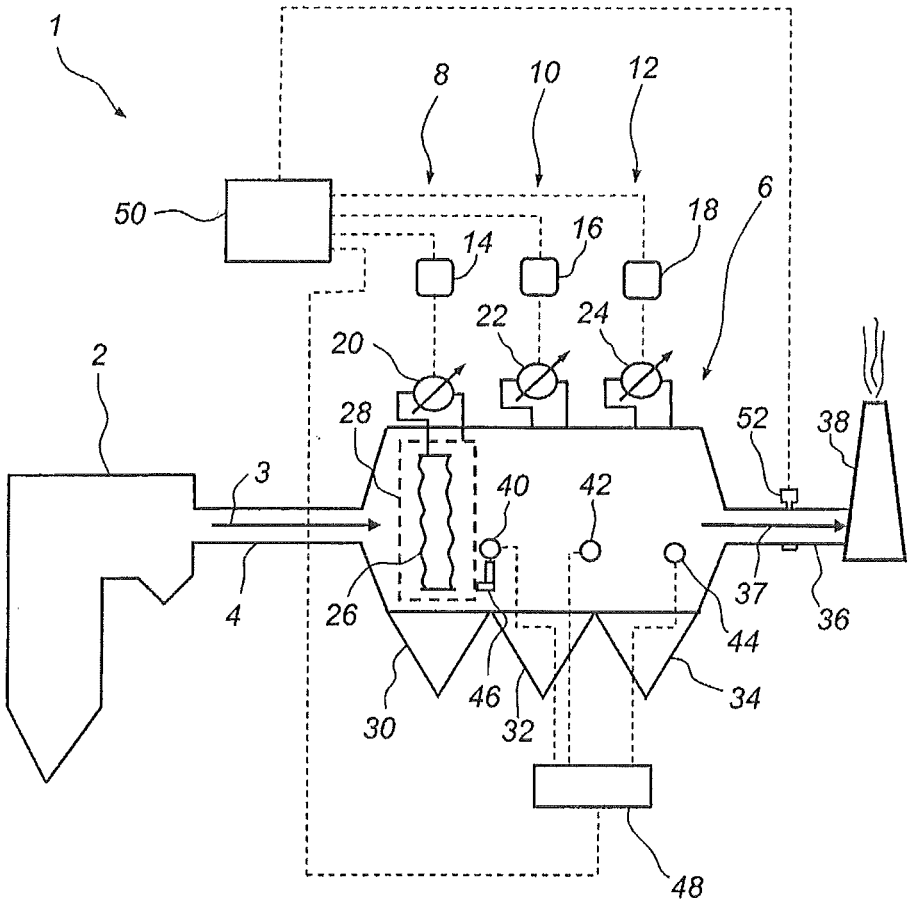
FIG. 1 is a schematic side view of a power plant equipped with an electrostatic precipitator.

FIG. 1 is a schematic side view and illustrates a power plant 1, as seen from the side thereof. The power plant 1 comprises a coal-fired boiler 2. In the coal-fired boiler 2 coal is combusted in the presence of air generating a hot process gas in the form of so-called flue gas 3 that leaves the coal-fired boiler 2 via a duct 4. The flue gas 3 generated in the coal-fired boiler 2 comprises dust particles, that must be removed from the flue gas 3 before the flue gas can be emitted to the atmosphere. The duct 4 conveys the contaminated flue gas 3 to an electrostatic precipitator, ESP, 6 which with respect to the flow direction of the flue gas is located downstream of the boiler 2. The ESP 6 comprises what is commonly referred to as a first field 8, a second field 10, and a third field 12, arranged in series, as seen with respect to the flow direction of the flue gas 3. The three fields 8, 10, 12 are electrically insulated from each other. Each of the fields 8, 10, 12 is provided with a respective control device 14, 16, 18 controlling the function of a respective high voltage supply 20, 22, 24, which may, for example, be a transformer rectifier.

Each of the fields 8, 10, 12 typically comprises several discharge electrodes and several collecting electrode plates, although FIG. 1, in the interest of maintaining clarity of illustration therein, only illustrates two discharge electrodes 26 and one collecting electrode plate 28 of the first field 8. In FIG. 1 it is schematically illustrated how the rectifier 20 applies power, i.e., voltage and current, between the discharge electrodes 26 and the collecting electrode plates 28 of the first field 8 to charge and precipitate the dust particles that are present in the flue gas 3. After being charged, the dust particles are precipitated on the surface of the collecting electrode plates 28. A similar process occurs in the second and third fields 10, 12. The collected dust is removed from the collecting electrode plates 28 by means of so-called rapping devices and is finally collected in hoppers 30, 32, 34. Each of the fields 8, 10, 12 is provided with a rapping device 40, 42, 44 respectively. Each of the rapping device 40, 42, 44 is designed to be operative to effect the cleaning of the collecting electrode plates 28, by means of rapping them, of the respective one of the fields 8, 10, 12 in question.

The rapping device 40 comprises, as illustrated in FIG. 1, a set of hammers, of which only one hammer 46, in the interest of maintaining clarity of illustration therein, is illustrated in FIG. 1. A more thorough description of one example of how such hammers might be designed can be found in U.S. Pat. No. 4,526,591. Other types of rapping devices can also be utilized, for instance, so-called magnetic impulse gravity impact rappers, also known as MIGI-rappers or a rapping device using sonic horns might also be employed for this purpose. The hammers 46 are designed to be operative to impact the collecting electrode plates 28, such that the dust particles collected thereon are caused to be released from the collecting electrode plates 28 and as such can then be collected in the appropriate one of the hoppers 30, 32, 34, which are located beneath each of the respective one of the fields 8, 10, 12 in question. The operation of the rapping devices 40, 42, 44 is designed to be controlled by means of a rapping controller 48. The rapping devices 40, 42, 44 may alternatively be controlled directly by the control devices 14, 16, 18, respectively. For instance, in a first mode of operation the collecting electrode plates 28 of the first field 8, in which normally most of the dust particles are collected, may be rapped, e.g., every 10 minutes, while the collecting electrode plates of the second field 10 may be rapped, e.g., every 30 minutes, and lastly the collecting plates of the third field 12 may be rapped, e.g., every 2 hours.

A duct 36 is provided that is designed to be operative for forwarding flue gas 37, from which at least part of the dust particles have been removed, from the ESP 6 to a stack 38. The stack 38 releases the cleaned flue gas 37 to the atmosphere.

A plant control computer 50 is provided that may communicate with the respective control devices 14, 16, 18, for example to control the output current of each electric power supply 20, 22, 24. The plant control computer 50 may also be operative to, for example via the rapping controller 48, control rapping of the collecting electrodes 28.

An opacity monitor device 52 is provided for detecting the opacity of the cleaned gas 37 as a measure of the dust particle concentration. The opacity monitor device 52 is thus operative for generating an opacity signal that can be used to evaluate the operation of the ESP 6. The opacity monitor device 52 may communicate with the plant control computer 50, as illustrated by the dotted line in FIG. 1, and/or with one or several of the control devices 14, 16, 18.

As discussed hereinbefore back-corona effects may influence the capability to remove dust particles from a process gas. The performance of a conventional ESP as regards cleaning of a gas containing particles that generate a high resistivity dust is typically relatively poor due to the occurrence of back-corona in the dust layer on the collecting electrode plates. To avoid excessive back-corona effects at normal operation the ESP current is typically significantly reduced in a conventional ESP. The situation may be further aggravated after long time of operation of such an ESP, since an inner dust layer of even higher resistivity is often formed. This inner layer is difficult to remove from the collecting plates by normal cleaning, such as e.g. conventional rapping, due to the strong electrical holding forces and the small size of the particles in the layer. In order to remove this inner layer forced cleaning of the collecting electrodes is required. Forced cleaning of the collecting electrodes differ from normal cleaning in that high resistivity dust, which would not be dislodged from the collecting plates by means of normal cleaning, such as e.g. rapping, is removed from the collecting plates during the forced cleaning operation.

In principle, increase of the ESP current increases the electrical holding force on the dust layer. However, it is here realized that this is only true up to a certain point, after which the onset of severe back-corona again leads to decreasing holding forces and even an effect of repelling dust from collecting plates at high current input. Based on this realization it has been found that forced strong back-corona may be used intermittently in order to clean the collecting electrodes from high resistivity dust. In this way collecting plates can be kept cleaner which minimizes back-corona effects during normal operation. In essence intermittent severe back-corona is used to reduce the negative effect of back-corona during normal operation.

The present disclosure relates to a control arrangement which controls the operation of the ESP 6 based on, for example, the presence and severity of back-corona in the dust layer on the collecting plates 28 in each individual field 8, 10, 12. As discussed hereinbefore, the collecting electrode plates 28 occasionally need to be cleaned from dust in a more forced way than the normal rapping instances. When it is determined that collecting electrode plates 28 of a field need forced cleaning from high-resistivity dust this field is operated with severe back-corona in the dust layer on the collecting electrode plates 28 during a predefined time interval. This allows the ESP operation to be improved as will be described later, while maintaining a low amount of dust particle residue in the output gas flow.

In a first mode of operation, which represents baseline operation for collecting dust particles, a first current is applied between the electrodes of the fields by the high voltage supplies 20, 22, 24, respectively. Typically, for high resistivity dust, a low average current density in the range of 2-50 μA per $m^2$ of collecting electrode plate area is used in the first mode of operation for optimum ESP performance.

When a need for forced cleaning of the collecting electrodes in an individual field is detected the collecting electrodes 28 of that field need to be cleaned from high resistivity dust. The respective one of the control devices 14, 16, 18 then obtains a forced cleaning signal. Typically, such a forced cleaning signal may be generated by a back-corona detection algorithm which is operative for determining the back corona status in each individual field 8, 10, 12. Preferably, a back-corona detection algorithm is installed in each of the control devices 14, 16, 18 making each such control device 14, 16, 18 include a back-corona detection system. Alternatively, a back-corona detection algorithm may be installed in the plant control computer 50. By way of exemplification and not limitation in this regard, measure of back-corona tendency and a subsequent forced cleaning signal could be generated by implementing an ESP operation optimizing algorithm which is operative to, automatically and continuously, optimize the voltage and current during normal operation in order to maximize the overall collection efficiency under varying process conditions. A thorough description of one example of how such an algorithm might be designed can be found in U.S. Pat. No. 5,477,464. However, a forced cleaning signal may alternatively be generated simply by a timer installed in each of the control devices 14, 16, 18 or a timer installed in the plant control computer 50. Such a timer may be set to generate a forced cleaning signal after a predefined time of operating in the first mode of operation. The timer setting depends on the composition of the flue gas to be cleaned and could be based on experience from earlier operations at the plant in question, or at other plants having similar flue gas composition. Preferably, such a timer is used in combination with an ESP back-corona detection algorithm and/or a signal indicative of the dust particle concentration, such as e.g. an opacity signal. In general the forced cleaning signal is correlated to the back-corona status at the collecting electrodes 28 of the ESP 6. A certain severity of back-corona may be used as detection criteria of a need for forced cleaning of the collecting electrodes 28. In response to the forced cleaning signal the ESP 6 enters a second mode of operation in which the average current applied between the electrodes 26, 28 of the field in question is increased significantly compared to the average current during operation in the first mode of operation. Such significantly increased average current causes the generation of a strong back-corona in the dust layer collected on the collecting electrode plates 28. In the second mode of operation the average current applied to the ESP may in some cases be increased to a level relatively close to the maximum rating of the high voltage supply. The resulting ionization generated inside the dust layer as an effect of the significantly increased average current and the strong back-corona generated thereby appears to "loosen up" the dust layer and eject at least a portion of the dust layer back into the gas flow. By performing a rapping event during operation in the second mode even more high-resistivity dust will be removed from the collecting electrode plates 28.

By ESP current is here meant the time average of the current that is fed to the electrodes of the ESP in order to charge and collect particles. Typically, the average current fed to the electrodes of an ESP is changed by setting the trigger timing in a thyristors circuit, although other concepts for supplying and altering the current are possible, e.g. by use of high-frequency power converters.

Commonly, intermittent energization of the electrodes is utilized when high-resistivity dust is experienced in the gas to be cleaned. The ESP may for instance employ a so-called semi-pulse control scheme. By a semi-pulse control scheme is here meant a scheme where, in an alternating current input current, not all half-periods are used to feed current to the ESP electrodes. Instead, every third, fifth, seventh, etc. (odd numbers in order to maintain an alternating current) are used. For instance, a charging ratio of 1:25, which means that one out of every 25 half-periods of the feed current is supplied to the electrodes 26, 28 of a particular field, may be used when high-resistivity dust is present in the flue gas to be cleaned. Typically, the charging ratio varies between the fields of the ESP 6. A reasonable example could be to use a charging ratio of 1:3 in the first field 8, a charging ratio of 1:15 in the second field 10, and a charging ratio of 1:25 in the third field 12. The separating of pulses with intermittent periods reduces the average current while retaining a good global current distribution inside the ESP, which minimizes back-corona effects in the first mode of operation to some extent. However, as discussed hereinbefore, upon the presence of a certain affinity for back-corona the collecting electrodes 28 may need forced cleaning to get rid of high-resistivity dust. Then a signal, which is indicative of a need for forced cleaning of the collecting electrode, is generated. In response to the receipt of the forced cleaning signal the operation of the ESP is switched from the first mode of operation into a second mode of operation. For instance, if a need for forced cleaning of the collecting electrodes of the third field 12 is detected the operation of the third field 12 is switched into a second mode of operation. In the second mode of operation a second average current, which is significantly higher than the average current applied in the first mode of operation, is applied between the electrodes 26, 28 of the third field 12 by the high voltage supply 24. For instance, the current may, in the second mode of operation, be increased such that the average current fed to the electrodes is increased by a factor of 25 compared to the average current fed to the electrodes 26, 28 in the first mode of operation. For example, the average current density may be increased from 10 to 250 μA per $m^2$ of collecting electrode plate area when switching from the first to the second mode of operation. The increased current input will cause severe back-corona, i.e. ionization inside the dust layer on the collecting electrode plate. The resulting ionization inside the dust layer will "loosen up" the dust cake on the collecting electrode plates and eject dust back into the gas stream, thereby causing a forced cleaning of the collecting electrodes 28 from high resistivity dust.

Figure 2:
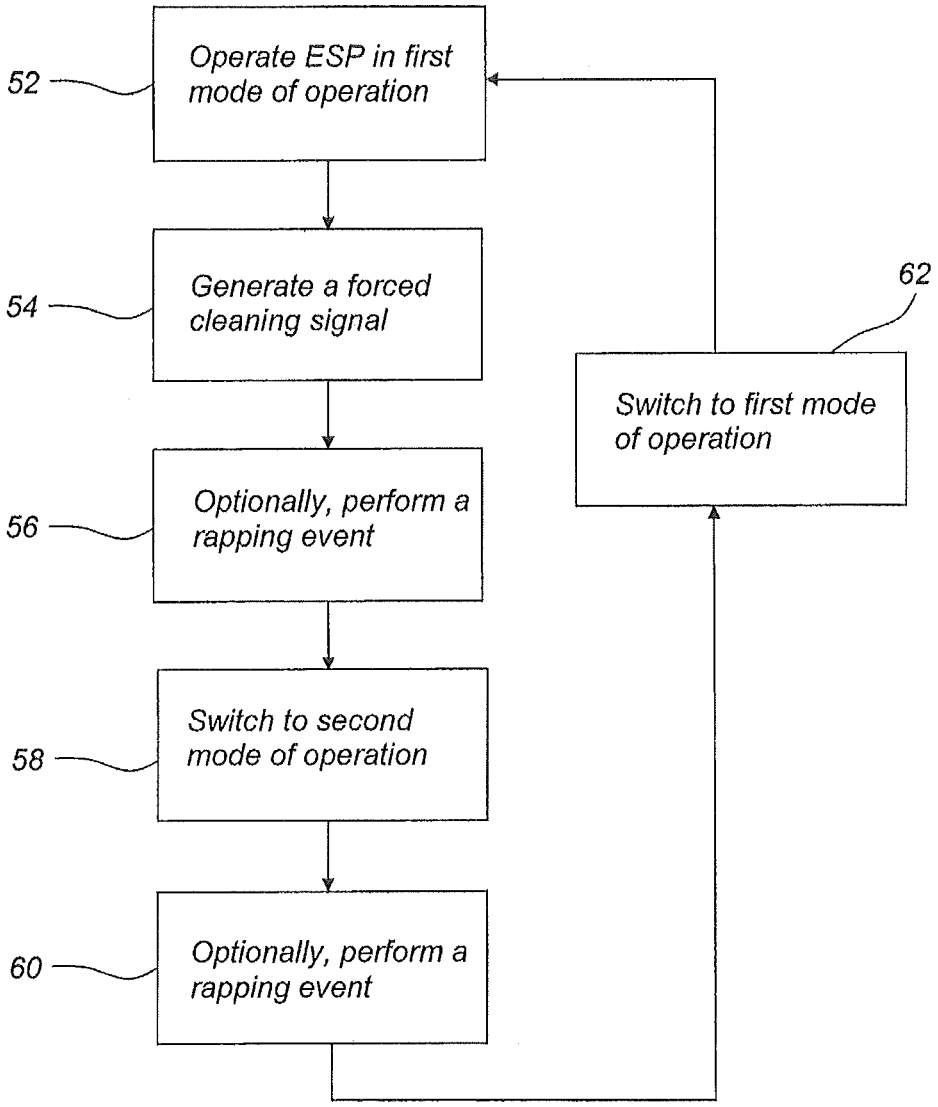
FIG. 2 is a schematic flow-diagram illustrating a method of controlling an electrostatic precipitator in accordance with one embodiment of the present invention.
Figure 3:
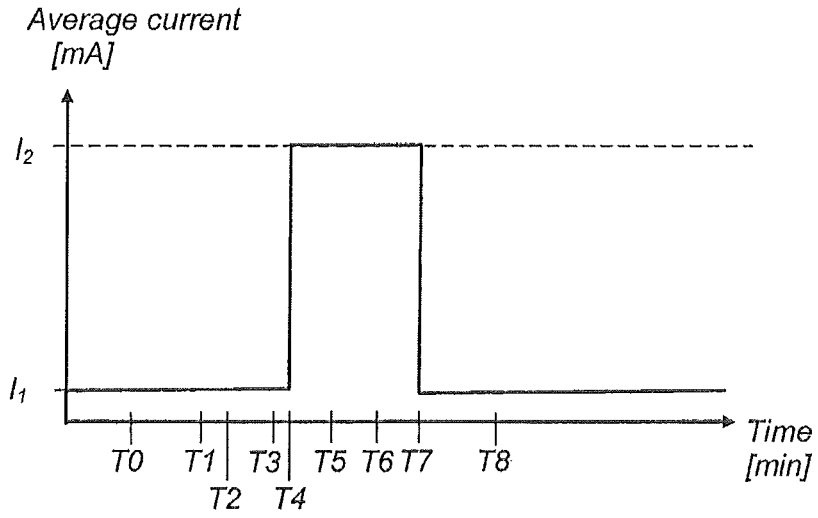
FIG. 3 is a schematic graph illustrating the operation of an electrostatic precipitator in accordance with one embodiment of the present invention.

FIG. 2 is a flow diagram and illustrates the steps of a first method of cleaning at least one collecting electrode of the ESP 6 in FIG. 1. In accordance therewith, in a first step, the latter being illustrated as 52 in FIG. 2 the ESP 6 is operated in a first mode of operation. In this mode a first average current $I_1$, depicted in FIG. 3, is applied between the discharge electrodes 26 and the collecting electrodes 28 of each field by a respective rectifier 20, 22, 24. Optionally, in a second step, the latter being illustrated as 54 in FIG. 2, a forced cleaning signal, which is indicative of a need for forced cleaning of the collecting electrodes 28 of one of the fields 8, 10, 12, is generated. The forced cleaning signal may, e.g., be generated by means of a back-corona detection system as described hereinbefore. The generation of such a forced cleaning signal includes a consideration of whether there exists a need for forced cleaning of the collecting electrode plates 28 of the field in question.

Optionally, in a third step, the latter being illustrated as 56 in FIG. 2, rapping with respect to the collecting plates 28 of a field where a need for forced cleaning of the collecting electrode has been detected is carried out in order to reduce the dust layer thickness as much as possible before a second mode of operation is entered. Optionally, this rapping may be of so-called power down rapping type, meaning that the power applied to the electrodes is reduced in conjunction with the rapping.

In a fourth step, the latter being illustrated as 58 in FIG. 2, the operation of the ESP 6 is switched from the first mode of operation to a second mode of operation. The ESP 6 is operated in the second mode of operation during a predetermined time interval selected to be in the range of, e.g., 20 seconds to 30 minutes, more preferably a predetermined time interval in the range of 30 seconds to 15 minutes and most preferably a predetermined time interval in the range of 1 to 5 minutes. In the second mode of operation a second average current, $I_2$, depicted in FIG. 3, which is significantly higher than the first current $I_1$, is applied between the discharge electrodes 26 and the collecting electrode plates 28. The current fed to a certain field may be increased in different ways. One way of increasing the current applied is to change the charge ratio setting of the rectifier in a semi-pulse arrangement. Typically, in the first mode of operation a charging ratio of 1:25 may be utilized in the third field 12. By changing the charging ratio to, e.g., a ratio of 1:1, the average current applied between the electrodes 26, 28 will be increased by approximately a factor of 25. Alternatively, the current may be increased by increasing the pulse amplitude or the continuous current so as to achieve the desired back-corona cleaning effect. Change of charging ratio and increase of the amplitude may of course also be combined.

Optionally, in a fifth step, the latter being illustrated as 60 in FIG. 2, rapping of the collecting electrode plates 28 of the field being operated in the second mode of operation is carried out. By carrying out rapping during operation in the second mode of operation the forced cleaning effect, i.e. removal of high-resistivity dust, will be further improved. In this case one rapping event is carried out. However, it is realized that two or more rapping events may be carried out during operation of the field in the second mode of operation. Preferably, a rapping event is carried out towards the end of the operation of the field in the second mode of operation such that the collected dust layer on the collecting electrode plates 28 is "loosened up" by the strong back-corona prior to the rapping event.

Furthermore, as depicted in FIG. 2 by means of a loop, the latter being illustrated as 62 in FIG. 2, the operation of the ESP 6 is then switched back to the first mode of operation to cause the ESP to be operated in the first mode of operation until there is again a need for a forced cleaning operation.

Referring now to FIG. 3 of the drawings, there is illustrated therein a schematic graph depicting the manner in which the first method operates by way of an example. At a time T0, identified as T0 in FIG. 3, the field in question of the ESP 6 is operated in the first mode of operation, and a first average current $I_1$ is applied between the discharge electrodes 26 and the collecting electrodes 28 of that field. At a time T1, identified as T1 in FIG. 3, a signal indicative of a need for forced cleaning of the collecting electrodes 28 of the field is generated. At a time T2, identified as T2 in FIG. 3, a rapping event with respect to the field is initiated. A rapping event is then carried out by the corresponding rapping device. At a time T3, identified as T3 in FIG. 3, this rapping event is completed. After the rapping event the control device, at time T4, identified as T4 in FIG. 3, switches the operation of the field from the first mode of operation to the second mode of operation as described hereinbefore. Hence, the current applied between the discharge electrodes 26 and the collecting electrodes 28 of the field is increased to a second average current, $I_2$, by the corresponding high voltage supply. The operation of the field in the second mode will last for e.g. 4 minutes. At a time T5, identified as T5 in FIG. 3, the corresponding rapping device is caused to perform a rapping event with respect to the field. At a time T6, identified as T6 in FIG. 3, this rapping event is completed. At a time T7, identified as T7 in FIG. 3, the control device switches the operation of the field from the second mode of operation to the first mode of operation, thus decreasing the average current supplied from the second current level, $I_2$, to the first current level $I_1$. At a time T8, identified as T8 in FIG. 3, the field is thus again operated in the first mode of operation.

Figure 4:
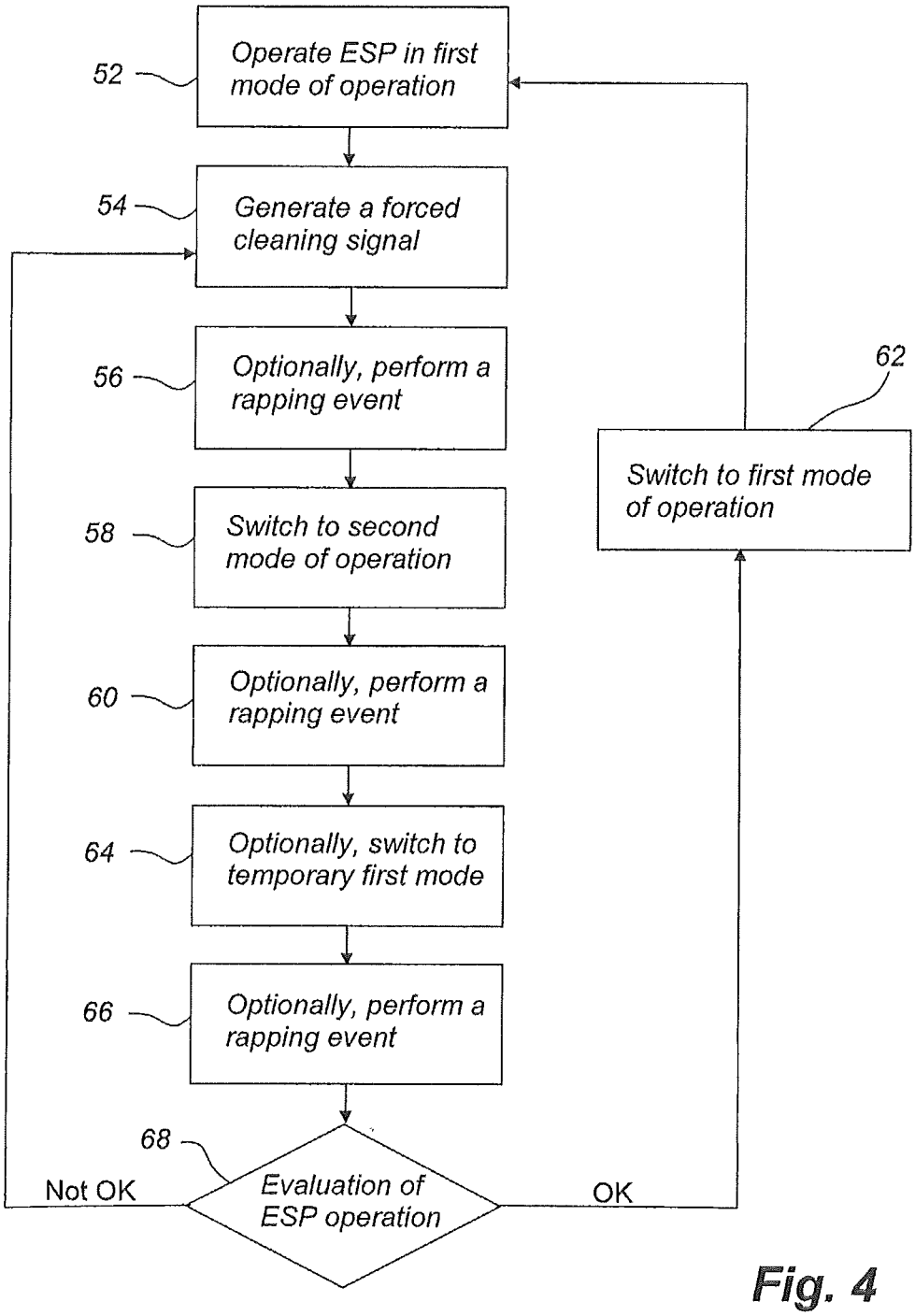
FIG. 4 is a schematic flow-diagram illustrating the operation of an electrostatic precipitator in accordance with an alternative embodiment of the present invention.

In FIG. 4 of the drawings, there is illustrated an alternative embodiment, to which reference has been had hereinbefore in connection with the discussion with regard to FIGS. 2 and 3 of the drawings. Hence, steps 52, 54, 56, 58, 60 and 62 of the embodiment of FIG. 4 will be performed in a similar manner as described hereinbefore with reference to FIGS. 2 and 3. This alternative embodiment differs from the earlier described embodiment in comprising additional steps, as will be described hereinafter. In accordance with this alternative embodiment evaluation of the ESP operation is carried out after a forced back-corona cleaning operation has been carried out. Hence, in a sixth step, the latter being illustrated as 64 in FIG. 4, the operation of the ESP is switched to a temporary first mode of operation.

Optionally, in a seventh step, the latter being illustrated as 66 in FIG. 4, rapping of the collecting electrode plates in the field that was previously operated in the second mode of operation but which is now operated in the temporary first mode of operation is carried out.

In an eight step, the latter being illustrated as 68 in FIG. 4, evaluation of the ESP operation, based on electrical readings or an opacity signal from the opacity monitor device 52 of FIG. 1, or combination thereof, is carried out. The evaluation step 68 involves consideration of detected differences in performance of the ESP in step 68 versus the earlier performance in step 52. If the operation is found to be "OK", then, as depicted in FIG. 4 by means of a loop, the operation of the ESP 6 is, according to step 62, switched back to the first mode of operation to cause the ESP to be operated in the first mode of operation until a new forced cleaning signal is generated. The operation of the ESP in the first mode after an operation in the second mode has been carried out may then be further optimized based on evaluation of the ESP operation. Hence, a successful forced cleaning operation may e.g. make it possible to apply a somewhat higher average current, $I_1'$, than the average current $I_1$ that was applied before the second mode was entered. On the other hand, if the operation of the ESP as evaluated in step 68 is found to be "Not OK" a forced cleaning signal is generated, as illustrated by an arrow back to the second step 54 in FIG. 4, and a new sequence of steps 54, 56, 58, 60, 64, 66 and 68 is initiated to obtain a further forced cleaning of the collecting electrode plates 28 of the ESP.

The above disclosure is considered particularly relevant for combustion processes and industrial processes that are prone to generate high resistivity dust, such as some coal-fired power plants, some metallurgical processes and some cement processes. With high resistivity dust is here meant dust with a resistivity in the order of $10^{11}$ Ωcm and higher, according to IEEE Standard 548-1984 or similar standards, even though the method may also be relevant for more conductive dust compositions.

A further issue that may cause problems in the above mentioned processes is when hydrocarbons, caused e.g. by poor combustion, contaminate collecting electrode plates and dust layer in the ESP. Removal of such hydrocarbons may also be assisted by forced cleaning according to the above disclosure.

It will be appreciated that numerous variants of the embodiments described above are possible within the scope of the appended claims.

Above it has been described, with reference to FIGS. 1-4, that the forced cleaning signal may be generated by a back-corona detection system. It will be appreciated that a forced cleaning signal may also be generated by a timer or a combination of timer and back-corona detection system. Based on the composition of the flue gas to be cleaned a need for forced cleaning of the collecting electrodes may be correlated with operating time. Hence, a timer may, e.g., be set to generate a forced cleaning signal in the last field every 24 hours. It is also possible to co-ordinate the forced cleaning with the normal cleaning, such as e.g. conventional rapping, of the ESP. This can e.g. be done based on a rapping schedule which governs the sequence of conventional rapping of the ESP. For instance, every fifth planned rapping event in a rapping schedule could be replaced by a forced cleaning. Alternatively, a forced cleaning could be initiated between two rapping events of a rapping schedule. Hence, a periodical forced cleaning signal may be generated based on a rapping schedule. Conventional rapping is typically carried out more often than forced cleaning. Preferably, seen over a long period of time, such as e.g. one week or one month, the number of conventional rapping events is at least three times higher than the number of forced cleaning operations.

Also, a signal indicative of the dust particle concentration, such as e.g. an opacity signal, may be included in the algorithm generating a forced cleaning signal.

In one embodiment a timer, a back-corona detection system, and a dust particle measurement device are employed to generate a forced cleaning signal. In addition to the periodical forced cleaning signal generated by the timer a forced cleaning signal is in this embodiment generated by the back-corona detection system or the dust particle measurement device whenever there is a need for forced cleaning. The timer may, e.g., be set to generate a forced cleaning signal in the last field every 24 hours. A need for forced cleaning may however arise more frequently. In addition to forced cleaning initiated by the timer, forced cleaning may thus be initiated based on information from a back-corona detection system or a dust particle measurement device. This embodiment has the advantage that further tuning possibilities as regards the generation of a forced cleaning signal are achieved.

Hereinbefore it has been exemplified that the third field is operated in a second mode of operation in response to a forced cleaning signal indicative of a need for forced cleaning of the collecting electrode in one field while the other two fields are operated in a first mode of operation. It is realized that each of the other fields may be operated in a second mode of operation in a similar manner. Preferably, two or more fields are not operated in a second mode of operation simultaneously due to the upset condition during forced back-corona condition.

Hereinbefore cleaning of collecting electrodes of an ESP having three fields has been exemplified. It is however realized that collecting electrodes of an ESP with more or less than three fields may be cleaned in an analogous manner.

As described hereinbefore, each of the control devices 14, 16, 18 is operative for receiving a signal containing information about the need for forced cleaning at each of the fields 8, 10, 12, respectively, and to switch operation mode in each of the fields 8, 10, 12 accordingly. As one alternative a central unit, such as the plant control computer 50, could be operative for receiving signals containing information about the need for forced cleaning at each of the fields 8, 10, 12, respectively, and to switch operation mode in each of the control devices 14, 16, 18 in accordance with the algorithm employed. Of course the forced cleaning signal can also be generated internally within the individual control devices 14, 16, 18.

As described hereinbefore the operation of the rapping devices 40, 42, 44 is designed to be controlled by means of a rapping controller 48. It is appreciated that the rapping control 48 may instead be integrated as a part of the control devices 14, 16, 18.

Hereinbefore it has been described, with reference to FIGS. 1-4, that the ESP 6 is operated in a first mode of operation, which represents baseline operation for collecting dust particles, and in a second mode of operation, in which forced cleaning is carried out. It will be appreciated that the ESP could be intermittently operated in further modes of operation for various reasons. In some cases operation in such an auxiliary mode could precede operation of the ESP in the second mode of operation. If such an auxiliary mode is used prior to switching the operation of the ESP to the second mode, the increase of the average current is related to the average current applied in the first mode of operation, i.e. the mode representing baseline operation for collecting dust particles.

To summarize, a method of cleaning an electrostatic precipitator 6 comprises applying, in a first mode of operation, a first average current between at least one discharge electrode 26 and at least one collecting electrode 28, and switching from the first mode of operation to a second mode of operation in which a second average current is applied between the discharge electrode 26 and the collecting electrode 28, the second average current being a factor of at least 3 higher than the first current $I_1$, to achieve a forced cleaning of the collecting electrode 28.

The invention claimed is:

1. A method of cleaning at least one collecting electrode of an electrostatic precipitator, which is operative for removing dust particles from a process gas and which includes at least one discharge electrode and the at least one collecting electrode; said method comprising:

applying, in a first mode of operation, a first average current between the at least one discharge electrode and the at least one collecting electrode, and switching from the first mode of operation to a second mode of operation in which a second average current is applied between the at least one discharge electrode and the at least one collecting electrode, the second average current being a factor of at least 3 higher than the first average current, to achieve a forced cleaning of the at least one collecting electrode.

2. The method according to claim 1, further comprising generating a forced cleaning signal which is indicative of a need for forced cleaning of the at least one collecting electrode and wherein switching from the first mode of operation to the second mode of operation is initiated in response to the forced cleaning signal.

3. The method according to claim 1, wherein the second average current being a factor of at least 10 higher than the first average current.

4. The method according to claim 1, wherein the electrostatic precipitator is operated in the second mode of operation during a predetermined time interval, preferably a predetermined time interval which is in the range of 20 seconds to 30 minutes.

5. The method according to claim 1, wherein switching from the first mode of operation to the second mode of operation is preceded by rapping the at least one collecting electrode.

6. The method according to claim 1, wherein a rapping of the at least one collecting electrode is carried out during the second mode of operation.

7. The method according to claim 1, further comprising generating a forced cleaning signal indicative of a need for forced cleaning of the at least one collecting electrode by means of a back-corona detection system.

8. The method according to claim 1, further comprising generating a forced cleaning signal indicative of a need for forced cleaning of the at least one collecting electrode by means of a timer.

9. The method according to claim 1, further comprising generating a forced cleaning signal indicative of a need for forced cleaning of the at least one collecting electrode by means of a dust particle measurement device measuring the dust particle concentration downstream, as seen with respect to the flow direction of the process gas, of the at least one collecting electrode.

10. The method according to claim 1, further comprising utilizing a rapping schedule for the cleaning of the at least one collecting electrode and issuing a forced cleaning signal indicative of a need for forced cleaning of the at least one collecting electrode on regular intervals in the rapping schedule.

11. The method according to claim 1, wherein the electrodes of the electrostatic precipitator are fed with current pulses, wherein the intermittent time between current pulses is shorter in the second mode of operation compared to the first mode of operation.

12. The method according to claim 11, wherein the intermittent time is decreased when switching from the first mode of operation to the second mode of operation by utilizing more potential pulses in a semi-pulse arrangement.

13. A device for controlling the cleaning of at least one collecting electrode of an electrostatic precipitator operative for removing dust particles from a process gas; said device comprising:

at least one discharge electrode;

the at least one collecting electrode; and a back-corona detection system for generating a forced cleaning signal indicative of a need for forced cleaning of the at least one collecting electrode.

14. The device according to claim 13, further comprising a timer for generating a forced cleaning signal.

* * * * *